United States Patent [19]

Deutsch et al.

[11] 4,205,576

[45] Jun. 3, 1980

[54] AUTOMATIC HARMONIC INTERVAL KEYING IN AN ELECTRONIC MUSICAL INSTRUMENT

[75] Inventors: Ralph Deutsch; Leslie J. Deutsch, both of Sherman Oaks, Calif.

[73] Assignee: Kawai Musical Instrument Mfg. Co. Ltd., Hamamatsu, Japan

[21] Appl. No.: 950,786

[22] Filed: Oct. 12, 1978

[51] Int. Cl.[2] ..... G10H 1/00; G10H 5/00

[52] U.S. Cl. ..... 84/1.17; 84/DIG. 22

[58] Field of Search ..... 84/1.01, 1.03, 1.17, 84/1.24, DIG. 2, DIG. 22

[56] References Cited

U.S. PATENT DOCUMENTS

| | | | |
|---|---|---|---|
| 3,711,618 | 1/1973 | Freeman | 84/1.03 |
| 3,712,950 | 1/1973 | Freeman | 84/1.03 |
| 3,823,246 | 7/1974 | Hebeisen et al. | 84/1.17 |
| 3,871,262 | 3/1975 | Robinson et al. | 84/1.17 |
| 3,908,502 | 9/1975 | Kidd et al. | 84/1.01 |
| 3,990,339 | 11/1976 | Robinson et al. | 84/1.17 |
| 4,112,802 | 9/1978 | Robinson et al. | 84/1.01 |
| 4,117,759 | 10/1978 | Kato | 84/1.03 |
| 4,149,441 | 4/1979 | Bergman et al. | 84/1.03 |

*Primary Examiner*—S. J. Witkowski

*Attorney, Agent, or Firm*—Christie, Parker & Hale

[57] ABSTRACT

An electronic digital type organ having one or more keyboards generating two or more harmonically related tones in response to keying a melody monophonically on one of the keyboards. The harmonic tones may be of different tonal quality, so as to produce the effect of different instruments. The harmonic tones are generated automatically at a pitch determined by either the next lowest note to the accompaniment notes played on another keyboard or, if no other key is depressed, a pitch that is determined by the melody note and stored half-tone interval information.

8 Claims, 5 Drawing Figures

KEY SIGNATURE SELECTOR
118
HARMONIC INTERVAL STORE
120
FROM GROUP COUNTER 50
SUBTRACT
140
TO MEMORY ADDRESS/ DATA WRITE 83

OCTAVE
DIV. 1
DIV. 2
DIV. 3
HARMONIC GENERATOR
116
DIV. 4
HARMONY NOTE SELECT
114
141
DIVISION 1
WRITE
A REGISTER
102
DIV. 2
B REGISTER
104
WRITE
S F/F Q
R
106
108
110
112
28a
28b
31a
31b
31a
31b
DIVISION 2

102
A REGISTER
B
A#
A
D
C#
C
104
B REGISTER
C
C#
D
A
A#
B
DIV. 4
143
141
114
OCTAVE
TO OR GATES 319
130a
130b
130c
130j
130k
130l
132a
132b
132c
132j
132k
132l
133a
133c
133j
133l
136a
136b
136c
136j
136k
136l
138a
138b
138l
139a
139j
139l

TO STORE AND COMPARE CIRCUITS 151
152a
152b
152i
152j
152l
C
C#
G#
A
A#
B
DIV. 1
DIV. 2
DIV. 3
150a
150b
150i
150j
150k
150l
TO 152g
TO 152h
TO 152h
OCTAVE
OR
154a
156a
154b
156b
154k
156k
154l
156l
143
DIV. 4
120
HARMONIC INTERVAL STORE
118
KEY SIGNATURE SELECTOR
128
OR CIRCUIT

HALT INC.
202
200
204
300
STATE F-F
59
S
Q
R
300
AUTOMATIC TRANSLOCATION
TO STORE AND COMPARE 51
DIV. 4
FROM CIRCUIT 28
Y
K
357
362
K=9
DATA SELECT
DIV. 4
DIV. 1
DIV. 2
DIV. 3
203
360
361
COUNTER
COUNT DOWN
11
12
0
1
356
359
358
104
B REG.
SHIFT
DIV. 2
DIV. 1
102
AREG
352
352
353
F-F
CLK
Q
S
R
B'
351
CLK
Q
S
350
F-F
K
FROM OR CIRCUIT 28

AUTOMATIC HARMONIC INTERVAL KEYING IN AN ELECTRONIC MUSICAL INSTRUMENT

FIELD OF THE INVENTION

This invention relates to digital type electronic organs, and more particularly, is concerned with apparatus for providing automatic harmonic interval keying in an electronic musical instrument.

BACKGROUND OF THE INVENTION

In U.S. Pat. No. 4,085,644 there is described a polyphonic tone synthesizer which generates a group of musical notes in response to actuation of keys on a keyboard by computing a master data list which defines the waveshape of each individual tone. The instrument may have a number of keyboards of divisions. A group of stops controls the waveform associated with the keys of each individual keyboard. In Pat. No. 4,022,098 there is described a keyboard switch detect and assignor circuit by means of which data identifying the note octave and keyboard of each key that is operated is stored in an assignment memory. This data is continuously updated as keys are released and new keys are actuated. The data in the assignment memory is used to control a group of tone generators for generating the corresponding audible tones. The present invention is directed to a modification to the keyboard switch detect and assignor circuit of U.S. Pat. No. 4,022,098, which is hereby incorporated by reference, to insert automatically note data into the assignment memory in response to operation of a selected key on the keyboard of harmonically related notes. The polyphonic tone synthesizer, in response to the information stored in the assignment memory, then generates the harmonically related tones.

Automatic harmony in electronic organs has heretofore been proposed. Such arrangements have derived information from the accompaniment played on a separate keyboard to select the harmonically related notes. Such known arrangements have the disadvantage that the harmonious note in the melody line could only be obtained if an accompaniment chord is played. However, if the accompaniment is played in a rhythm, then the harmonic note in the melody line is forced to follow the same rhythm. In addition, such known automatic harmony systems have been limited to generating a harmony note that has the same tonal quality as the melody note.

The present invention provides an improved automatic harmony generator in which harmonic tones can be generated in the melody line even when an accompaniment note is not played and in which the harmonic note may have a different tonal characteristic than the melody note.

SUMMARY OF THE INVENTION

These and other features of the present invention are achieved by a coupling arrangement in which operation of a melody note on one keyboard causes at least one additional tone to be generated automatically. The additional tone has a pitch that corresponds to the next lower note to the melody note but played on an accompaniment keyboard. However, if the next lowest note is only a half-tone or less below the melody note, a note that is either a major 3rd (four half-tones) or a minor 3rd (three half-tones) below the melody note is generated. The key signature in which the melody is played is used to determine for each melody note played if the major or minor third is used to generate the harmony note.

DESCRIPTION OF THE DRAWINGS

For a better understanding of the invention, reference should be made to the accompanying drawings, wherein.

DETAILED DESCRIPTION

Figure 1:
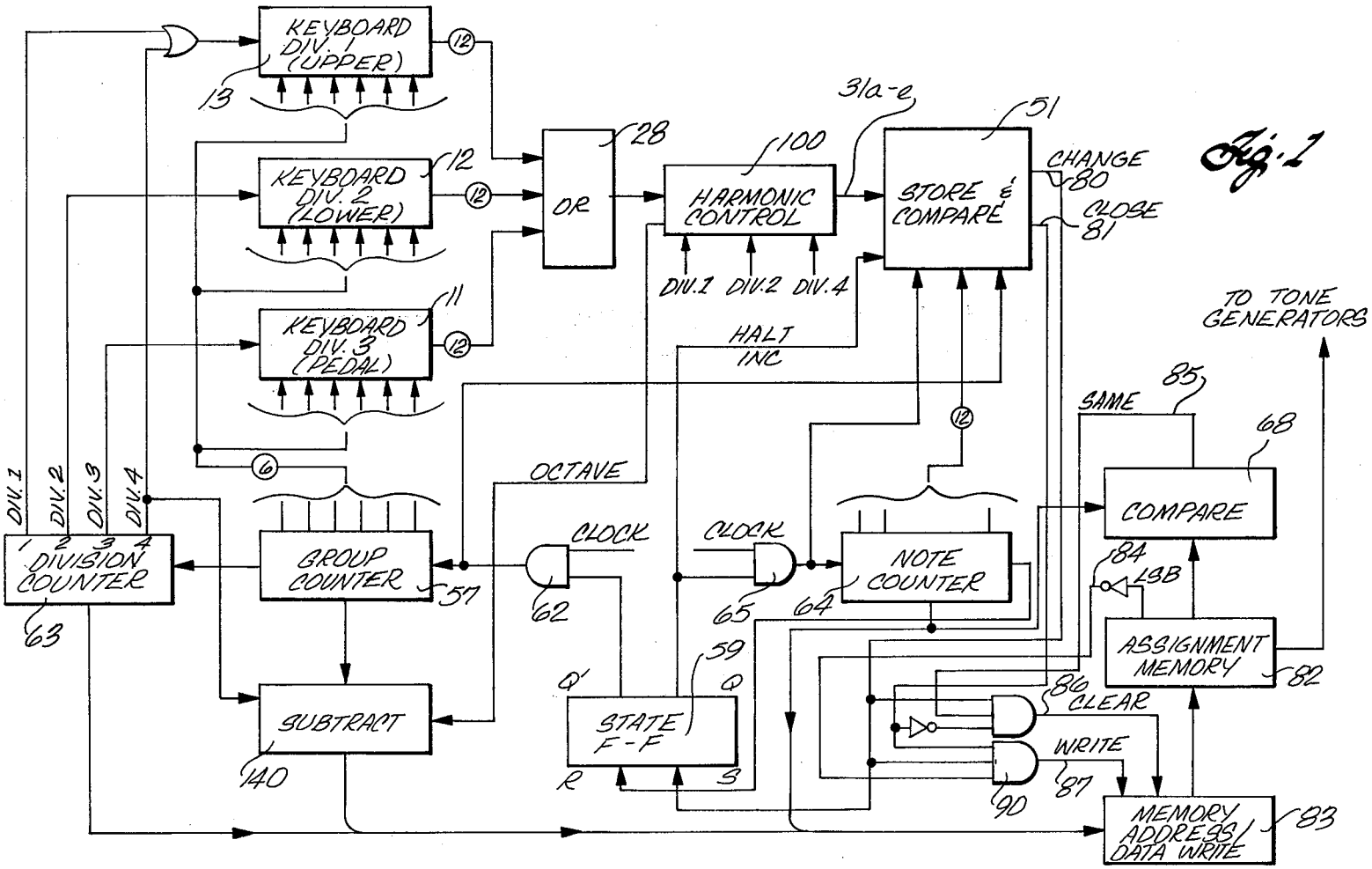
FIG. 1 is a schematic block diagram of a key detect and assignor circuit incorporating the harmonic control of the present invention.

Referring to FIG. 1, there is shown in block form a keyboard switch detect and assignor circuit of the type described in detail in U.S. Pat. No. 4,022,098, hereby incorporated by reference. Two digit reference characters used in FIG. 1 identify the same circuit elements as the corresponding reference numbers in the referenced patent.

In the preferred embodiment of the invention as described it is assumed that the musical instrument is provided with three keyboards, an upper keyboard referred to as Division 1, a lower keyboard referred to as Division 2, and a pedal keyboard referred to as Division 3, indicated as 13, 12, and 11, respectively, in FIG. 1. Each keyboard includes, for example, six octaves of twelve keys, namely keys C through B of the musical scale for each octave. Operation of a key on any keyboard closes a switch. The key-operated switches are scanned by division and by octave by a group counter 57 and division counter 63 which are counted in response to clock pulses received through an AND circuit 62. As each group of switches is activated by the group counter 57, the key switches of the twelve keys in that group are connected to twelve output lines from the associated keyboard circuit, the status of each switch determining the binary level on an associated one of the output lines. The twelve output lines from each of the three keyboards are combined by an OR circuit 28 and connected to the input of a store and compare circuit 51.

The twelve input lines to the store and compare circuit from the OR circuit 28 are compared with information stored in a group of registers in the store and compare circuit which store the status of each key-operated switch during the previous scan by the group counter and division counter. If there has been a change of status in any of the keys in a particular group, the store and compare circuit 51 provides an output signal on the output line 80 indicating that a change in status of one of the keys has occurred since the previous scan of that group of key switches. This sets a state flip-flop 59 which halts the scanning by the group counter and division counter and at the same time activates a note counter 64. It also provides a Halt inc signal to the store and compare circuit 51 before initiating an assignment mode of operation.

During the assignment mode, the note counter 64 causes the store and compare circuit 51 to scan the twelve input lines sequentially to determine which lines have had a change in status. If a key switch has been closed since the previous scan of the group switches, the store and compare circuit 51 provides a signal on the output line 81 indicating that the key switch identified by the division, group, and note counters has been closed. This is detected by an AND circuit 90 which then causes the contents of the note counter, group counter, and division counter to be stored in an assignment memory 82 under control of a memory address-/data write circuit 83. If a particular key has been released since the previous scan, a signal is provided on an output line 86 which causes the word identifying the particular key to be cleared from the assignment memory 82.

As thus far described, the key detect and assignor circuit of FIG. 1 operates substantially the same as the circuit described in detail in the above-identified referenced U.S. Pat. No. 4,022,098. However, to implement the harmonic control of the present invention, the division counter 63 is provided with an additional count state, corresponding to Division 4. When the division counter 63 points to Division 4, it again activates the Division 1 keyboard 13. Thus the upper keyboard 13 is time-shared by Division 1 and Division 4. When in the Division 4 state, division, group, and note information identifying a note harmonically related to the melody note played on keyboard 13 is stored in the assignment memory 82 in a manner hereinafter described in detail. The harmonic note data always stores the division number as identifying Division 4.

With the division counter 63 in the Division 4 state, a harmonic control circuit 100 operates to put a signal on one of the twelve output lines 31*a* through 31*l* which is harmonically related to a key actuated on the Division 1 keyboard. It is assumed that the Division 1 keyboard is played monophonically when operating in an automatic harmonic mode. The keyboard can be limited to a monophonic operation by only playing one key at a time or by using a monophonic control circuit such as described in copending application Ser. No. 712,736, filed Aug. 9, 1976, entitled "An Automatic Digital Circuit for Generating Chords in a Digital Organ", by the same inventor as the present application, assigned to the same assignee, now U.S. Pat. No. 4,100,831, and hereby incorporated by reference. The harmonic control 100, in response to a particular key being actuated on the Division 1 keyboard, provides a signal on one of the output lines 31*a*–31*l* corresponding to the next lowest note played on the Division 2 keyboard 13. However, if the next lowest note is not more than a half tone lower than the melody note played on the Division 1 keyboard, the harmonic control 100 provides a signal on one of the output lines 31*a*–31*l* to signal a key that is either a minor 3rd or a major 3rd below the melody key.

Figure 2:
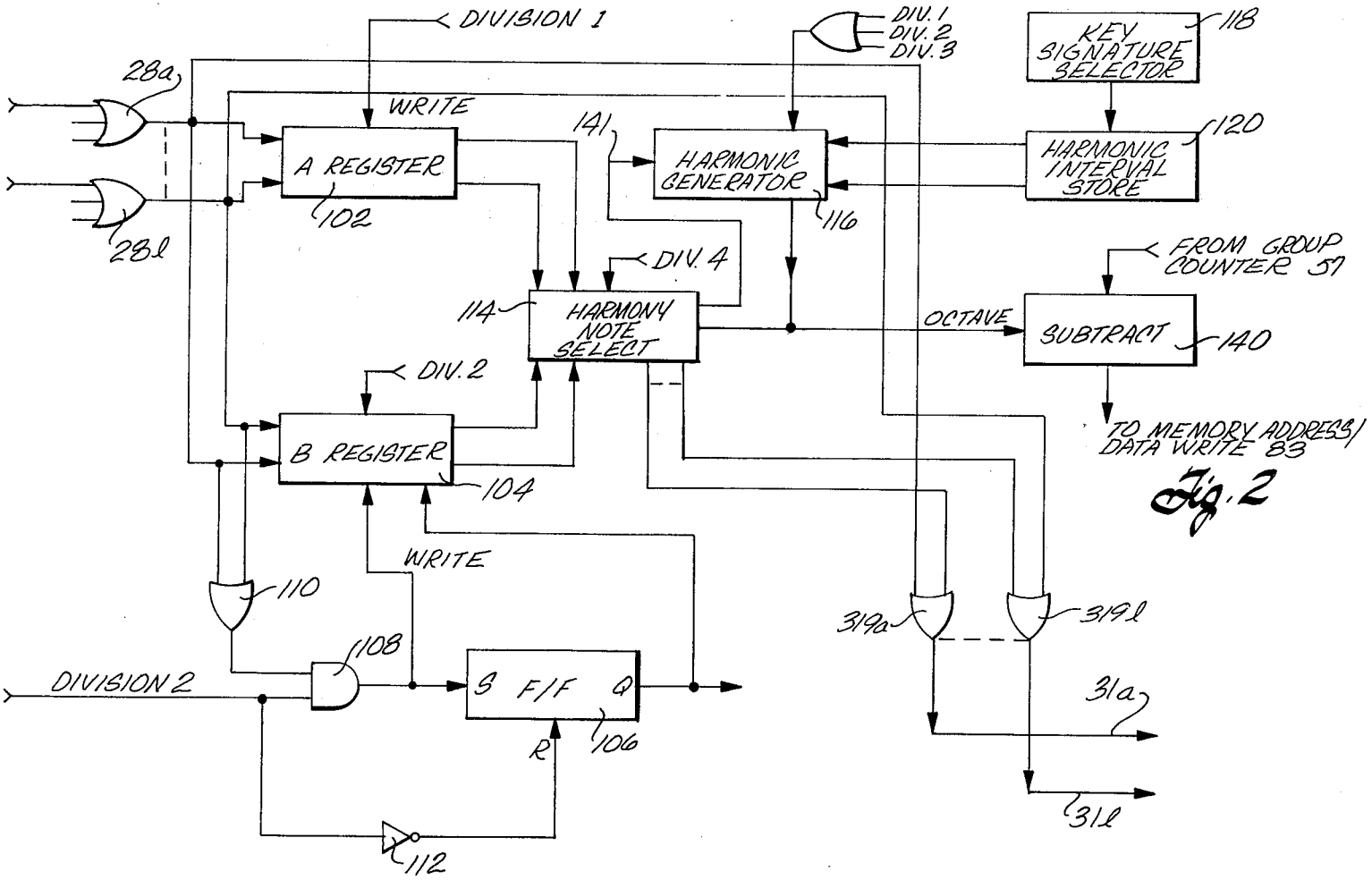
FIG. 2 is a block diagram of the harmonic control.

The harmonic control circuit 100 is shown in more detail in FIG. 2. The twelve output lines from the OR circuit 28*a*–28*l* are applied to an A register, indicated at 102, which stores twelve bits, one bit for each of the twelve input lines. The A register is activated during the Division 1 state of the division counter 63 so that any key actuated on the upper keyboard 13, regardless of which octave it is played in, causes a bit to be stored in the A register indicating which note of an octave has been depressed. Since the melody is normally played on the upper keyboard monophonically, the melody note is identified by the contents of the A register. At the same time, the status of the melody note key on the upper keyboard is applied directly to the appropriate one of the output lines 31*a*–31*l* going to the store and compare circuit 51, causing the status of the division counter, group counter, and note counter for the operated key to be stored in the assignment memory 82 in the normal manner.

When the division counter advances to the Division 2 state, the status of the keys on the keyboard of Division 2 are stored in a register B, indicated at 104. The B register is activated by setting a control flip-flop 106 by the output of an AND gate 108 which senses that the Division 2 state is present and that at least one of the keys on the lower keyboard has been activated, as sensed by a logical OR circuit 110 to which the twelve lines from the OR circuit 28 are connected. The output from the AND gate 108 clears the B register 104 so that when the control flip-flop 106 is set, the B register is in a condition to store the status of the key switches in the Division 2 keyboard. When the division counter advances to Division 3, the control flip-flop is reset through an inverter 112.

With the A register storing information as to the melody note in Division 1, and the B register storing information as to the accompaniment notes played in Division 2, the division counter 63 advances to Division 3, during which the pedal note information is received by the store and compare circuit 51, and then advances to Division 4.

During the time the division counter is in the Division 4 state, a harmony note select circuit 114 selects a harmony note based on the information stored in the register 102 and the register 104 and activates one of the twelve lines 31*a* through 31*l* going to the store and compare circuit 51. If the harmony note select circuit 114 determines that the harmony note is in the next lower octave, it provides a signal on the output of an OCTAVE line to a subtract circuit 140 which decrements the output of the group counter 57 by one, thereby decreasing the group number by one for the harmony note as it is stored in the assignment memory 82. In the event no accompaniment keys have been operated on the lower keyboard or in the event a single key has been operated which is the same or a half tone lower than the melody note, the harmony note select circuit 114 does not activate any of the twelve output lines going to the store and compare circuit 51. Instead, the harmony note select circuit 114 activates a harmonic generator circuit 116.

Figure 4:
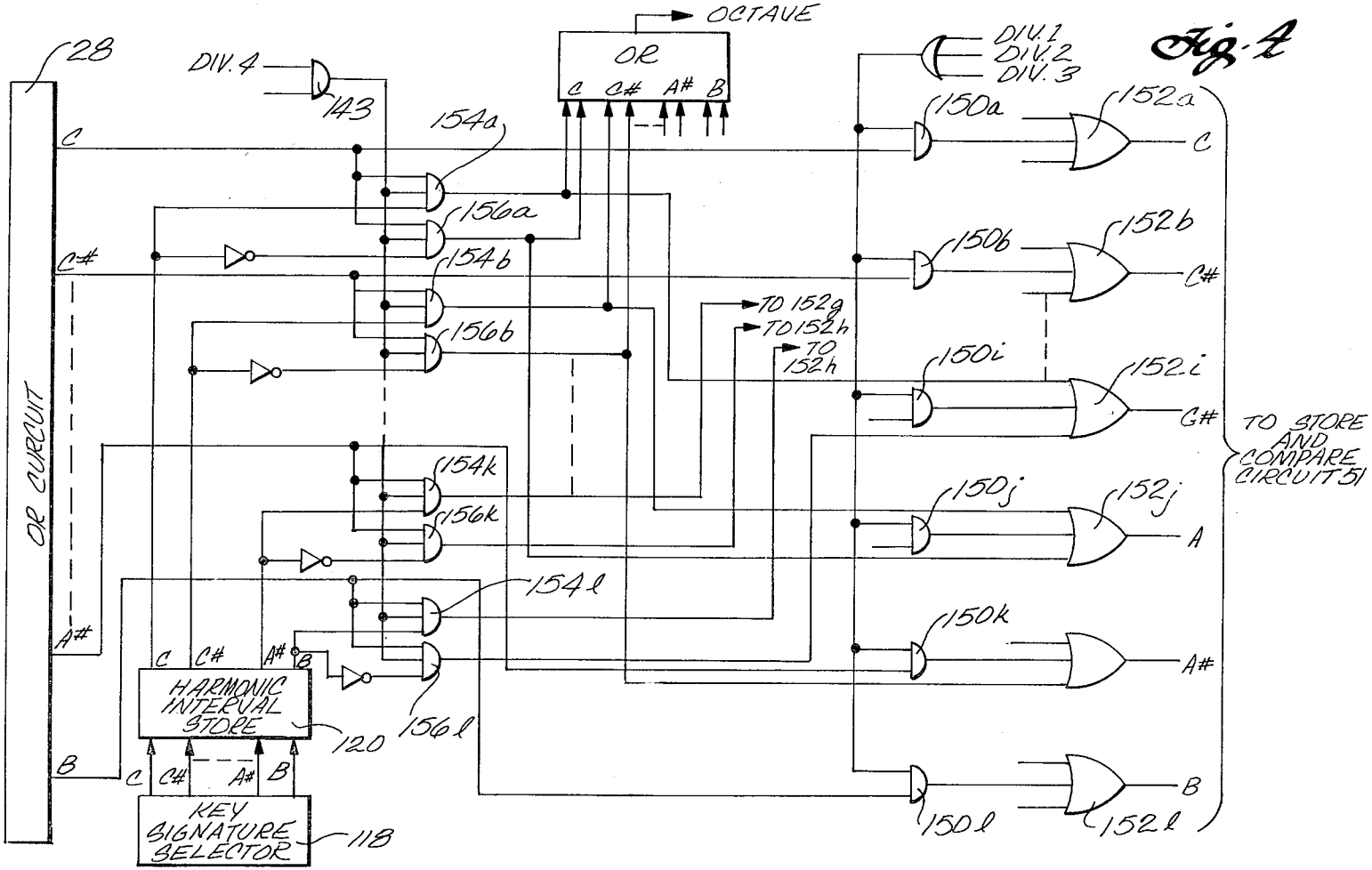
FIG. 4 is a logic block diagram of the harmonic generator.

The harmonic generator circuit 116, as hereinafter described in detail in connection with FIG. 4, is used to generate a harmony note which is either a minor 3rd or a major 3rd below the melody note, depending upon which key in the upper keyboard has been depressed and the key signature in which the melody is being played. The latter condition is controlled by a key signature selector circuit 118 which controls a harmonic interval store 120. The store 120 stores information as to which notes produce a minor 3rd harmony and which notes produce a major 3rd harmony, all in a manner as hereinafter described in detail.

Figure 3:
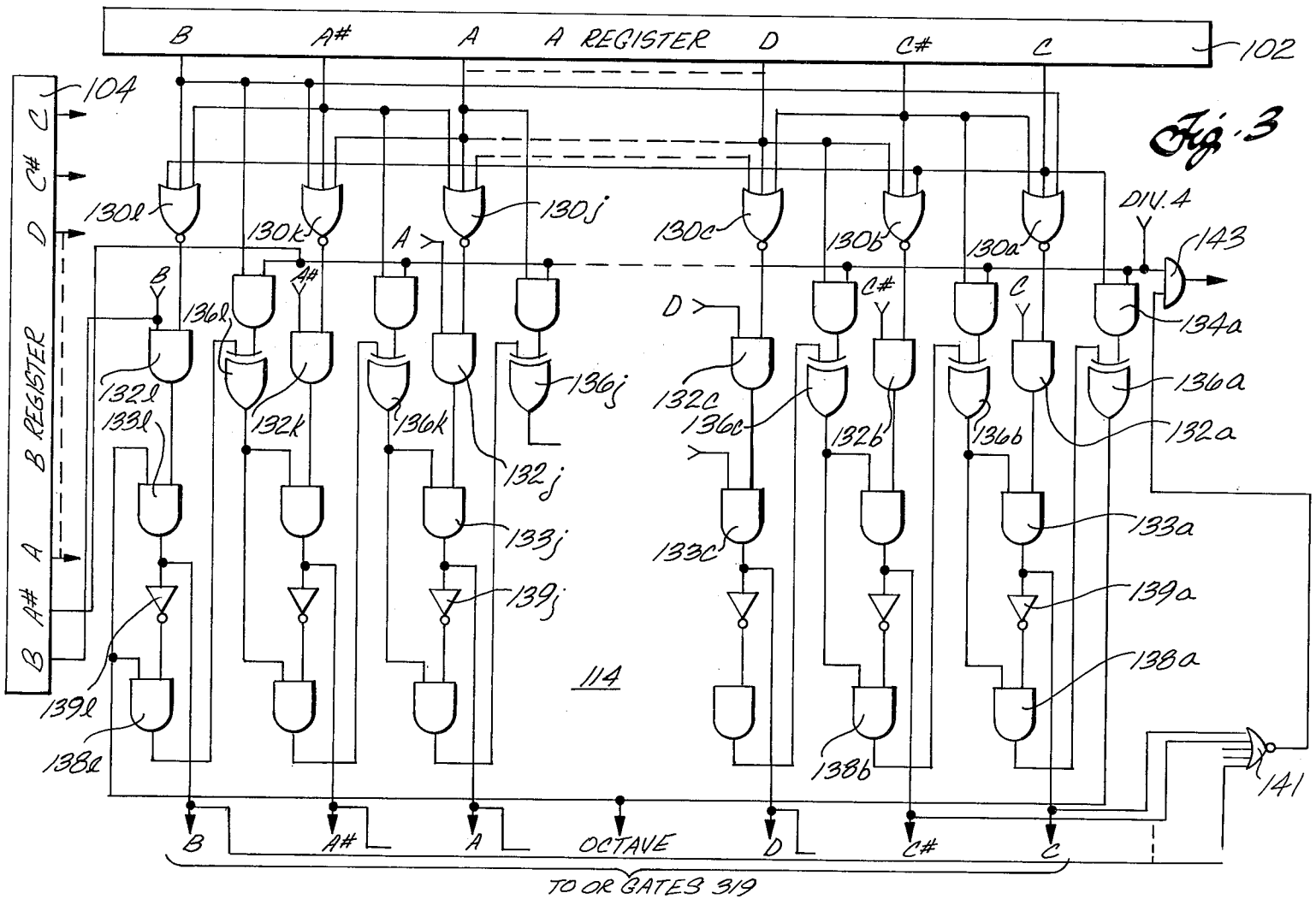
FIG. 3 is a logic block diagram of the harmony note select circuit.

The harmony note select circuit 114 is shown in detail in FIG. 3. The melody note information stored in the A register operates to select the activated highest note as stored in the B register. Also any note stored in the A register will inhibit three notes, the melody note itself and the immediate adjacent notes a half tone above and a half tone below the melody note. The inhibiting is provided by a NOR gate and an AND gate associated with each note from the A register, as indicated at 130*a*–130*l*. Each NOR gate has three inputs, one from the associated note signal from the A register, and one from the note signal a half tone above and a half tone below that. Only if none of the three notes associated with a NOR gate are present will the output of the NOR gate be true. The output of each of the NOR gates 130*a*–130*l* provide one input to an associated one of a group of AND gates, indicated at 132*a*–132*l*. Each of the AND gates 132 receives a second input from a corresponding one of the note signals from the B register. Thus the output of an AND gate 132 will be true if not inhibited by the associated NOR gate 130 being false, i.e., the corresponding accompaniment note is played on the lower keyboard 12 or the note a half tone above or a half tone below is the melody note.

Since there may be several AND gates 132 in which the output is true, it is necessary to select the highest uninhibited note signal from the B register 104 as the output from the harmonic note select circuit. This is accomplished in the following manner. Each of the output signals from the A register 102 are applied to an associated one of a group of AND gates 134*a* through 134*l* together with the Division 4 line from the division counter 63. The output of only one of the AND gates 134 will be true depending upon which melody note signal is present at the output of the A register. The output of the AND gates 134 are applied to one input of an associated one of a group of EXCLUSIVE OR gates indicated at 136*a* through 136*l*. The outputs of the EXCLUSIVE OR gates are connected as one input to an associated group of AND gates 133*a*–133*l*. The output of each EXCLUSIVE OR gate is connected to the AND gate associated with the next highest note. The output of the EXCLUSIVE OR gate 136*b* is connected as one input to the AND gate 133*a*. The other input to each of the EXCLUSIVE OR gates 136 is derived from associated ones of a group of AND gates 138*a*–138*l*. Each AND gate 138 derives one input from the EXCLUSIVE OR gate of the next lowest note, while the other input to the AND gates 138 is derived through an associated one of a group of inverters 139*a*–139*l* from the output of the associated one of the AND gates 133*a*–133*l*. It will be seen that this logic is connected in a closed loop which passes priority to the highest activated note signal from the B register that is more than a half tone above or below the melody note signal from the A register.

When priority is passed by the EXCLUSIVE OR gate 136*a* from note C to the next lower note B, this in effect constitutes a change to the next lower octave relative to the current octave indicated by the group counter 57. The shift in octaves is signaled by the output from the EXCLUSIVE OR gate 136*a* on an octave output line.

As shown in FIG. 1, the OCTAVE signal from the harmonic control is applied to a subtract circuit 140 which is activated when the division counter is in the Division 4 state. The subtract circuit decrements the output from the group counter 57 by one. Thus the group counter information stored in the assignment memory 82 for the harmonic note indicates the next lower octave when the OCTAVE signal from the harmonic control is on.

In the event that no key has been depressed on the lower keyboard 12 when operating in the automatic harmony mode, or in the event only a single key is played on the lower keyboard which is either identical to or a half tone above or below the melody note played on the upper keyboard, the output of a NOR gate 141 goes true, providing an output signal from AND gate 143 during the Division 4 state. (See FIG. 3). The output activates an alternative arrangement for generating a harmony tone by activating the harmonic generator 116 in combination with the key signature selector 118 and harmonic interval store 120. The harmonic generator functions to provide harmonic tones which are based on the key signature. It has been found that a pleasing harmony can be produced if the harmony tone is played lower than the melody note and is caused to be either four half-tones (a major 3rd) or three half-tones (minor 3rd) below the melody note. The following table lists the notes and simple harmonic notes for a scale played in the key of C and in the key of C♯.

TABLE I

| Key: C | 0 | 1 | 2 | 3 | 4 | 5 | 6 | 7 | 8 | 9 | 10 | 11 |
|---|---|---|---|---|---|---|---|---|---|---|---|---|
| actuated note | C | C♯ | D | D♯ | E | F | F♯ | G | G♯ | A | A♯ | B |
| harmonic note | A | A♯ | B | B | C | D | D♯ | E | F | F | G | G |
| half-tone separation | 3 | 3 | 3 | 4 | 4 | 3 | 3 | 3 | 3 | 4 | 3 | 4 |
| binary code | 1 | 1 | 1 | 0 | 0 | 1 | 1 | 1 | 1 | 0 | 1 | 0 |

For the key of C♯ the relations become

| Key: C♯ | | | | | | | | | | | | |
|---|---|---|---|---|---|---|---|---|---|---|---|---|
| actuated note | C♯ | D | D♯ | E | F | F♯ | G | G♯ | A | A♯ | B | C |
| harmonic note | A♯ | B | C | C | C♯ | D♯ | E | F | F♯ | F♯ | G♯ | G♯ |
| half-tone separation | 3 | 3 | 3 | 4 | 4 | 3 | 3 | 3 | 3 | 4 | 3 | 4 |
| binary code | 1 | 1 | 1 | 0 | 0 | 1 | 1 | 1 | 1 | 0 | 1 | 0 |

Where n is the half-tone difference between the signature key and the actuated note.

From the above table it will be seen that the harmonic separation for the key of C♯ is obtained from that for the key of C by shifting the half-tone separation number relative to the actuated key by a half tone. A similar half-tone shift holds true for all other key signatures. Thus by knowing the key signature, the number of right shifts of the half-tone separation number relative to the actuated key is known. Thus an essential input control for the automatic harmonic generator 116 is the key signature of the music to be played. Since the half-tone separation numbers are either 3 or 4, it is convenient to represent these two separation numbers by the binary values 0 and 1. Assuming that a half-tone separation of four half tones is represented by binary 0, and a half-tone separation of 3 is represented by a binary 1, the resulting binary pattern is that shown in the above table. The binary pattern for each key signature can be separately stored in the store 120 and the appropriate pattern from the store selected by the selector 118.

Referring to FIG. 4 in detail, the twelve output lines from the OR circuit 28 corresponding to notes C through B are coupled through AND gates 150*a* through 150*l* through OR gates 152*a* through 152*l* to the twelve input lines of the store and compare circuit 51. The AND gates 150*a* through 150*l* are turned on during Division 1, Division 2, and Division 3 states of division counter 63 to transfer the signals on the output lines from the keyboard directly to the store and compare circuit 51. When operating in the Division 4 state, each output line from the OR gate 28 is shifted down either three or four half tones relative to the output lines from the OR gates 152 going to the store and compare circuit 51. Thus a pair of AND gates 154*a* and 156*a* selectively couple the output of the C note from the OR circuit 28 either to the OR gate 152*i* or the OR gate 152*j* where output lines correspond to the notes G♯ and A.

Similar pairs of AND gates 154b–154l and 156b–156l selectively connect each of the lines from the OR circuit 28 to particular ones of the OR gates 152a through 152l. The logic is designed to conform with the table above to provide either a three half-tone or a four half-tone down shift of the outgoing notes relative to the ingoing notes. For example, a signal indicating that the note C is being played in the upper division signals either the note A on the output line from the OR gate 152j or the note G# by the output of the OR gate 152i. By actuating one or the other of each pair of AND gates, either a three half-tone shift or a four half-tone shift is provided according to the relationship set forth in the above-identified table. To this end, the harmonic interval store 120 stores twelve bits having the binary pattern shown in the above table for each key signature. One twelve-bit pattern is selected for each setting of the key signature selector circuit 118. The store may comprise a read-only memory (ROM), a hand-wired decoder circuit, or single shift register. If a shift register is used, the binary pattern is shifted relative to the input lines by a number of shifts determined by the value of the key signature.

While a three half-tone or four half-tone shifts to generate a harmonic tone that is either a minor 3rd or a major 3rd interval below the melody note is prefered, it will be understood that other relationships between the automatically generated harmony notes and the melody notes may be provided. An arrangement for achieving any amount of relative shift between the input and output lines of the harmony control circuit 100 is disclosed in copending application Ser. No. 951,168, filed Oct. 13, 1978, entitled "Intrakeyboard Coupling and Transposition Control for a Keyboard Musical Instrument", by the same inventor as the present application and assigned to the same assignee.

Figure 5:
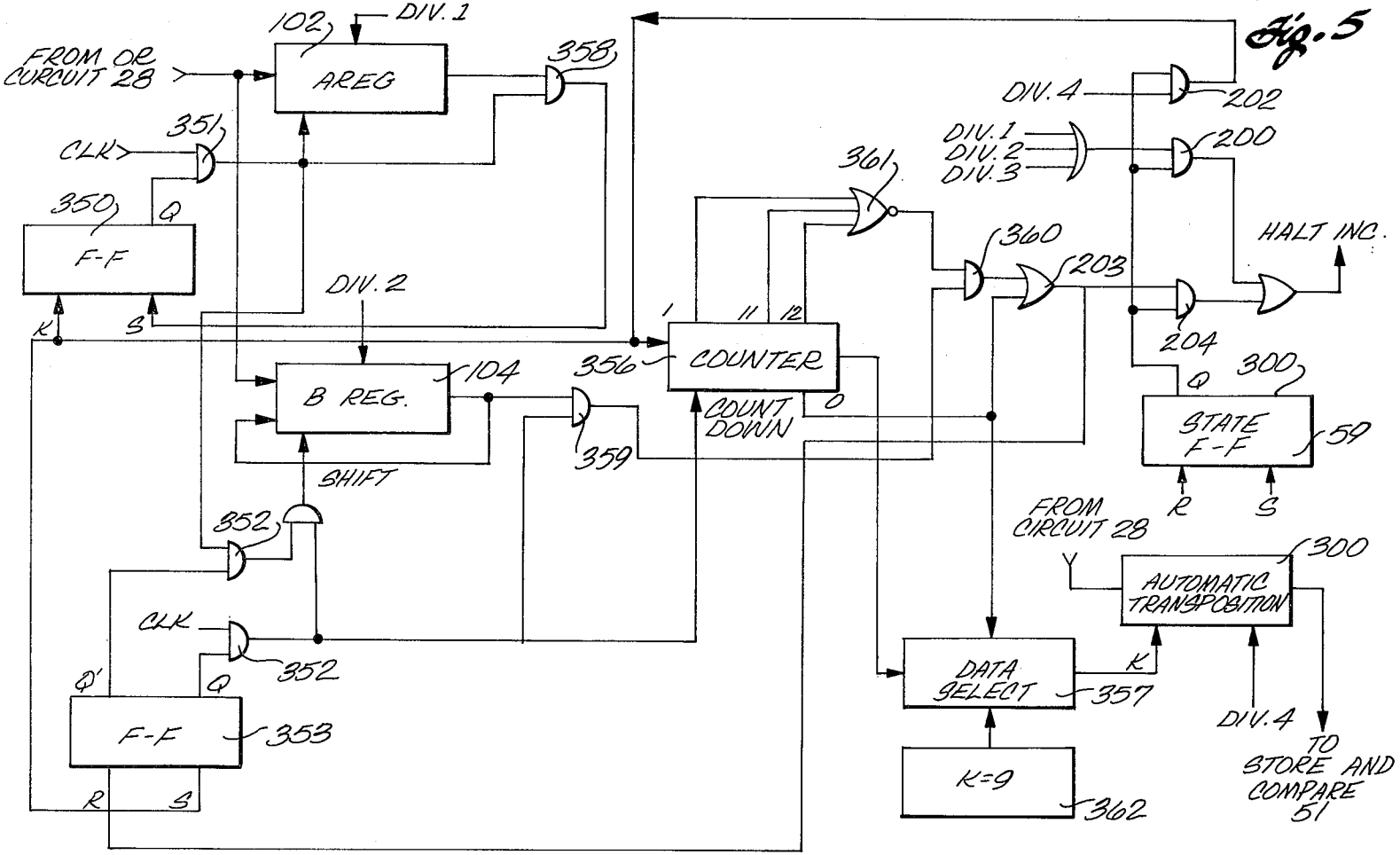
FIG. 5 is a schematic block diagram of an alternative embodiment of the present invention.

An alternative embodiment of the harmony note select circuit 114 and a harmonic generator 116 of FIG. 2 is shown in the embodiment of FIG. 5. In the arrangement of FIG. 5, the loading of the A register 102 and B register 104 during Division 1 and Division 2 operation is identical to that described in connection with FIG. 2. Thus when the division counter 63 advances to the Division 4 state, one bit of the twelve bits stored in the A register is set to 1, indicating which note of an octave has been activated by depressing a key on the Division 1 keyboard. Likewise the B register 104 has one or more of the twelve bits of the register set to 1 to identify the notes whose keys have been activated on the Division 2 keyboard. As noted above, the setting of the bits in the A register and B register are independent of which octave on the keyboard the activated keys are in.

With the division counter 63 advanced to the Division 4 state, the Division 1 keyboard is again scanned by the group counter 57. As the keys of each group are compared in the store and compare circuit 51, if any key has been depressed since the previous scan, the state flip-flop 59 is set in the manner described in detail in the above-identified U.S. Pat. No. 4,022,098. When the state flip-flop 59 is set, a HALT INC signal is generated by the output of an AND gate 200, the HALT INC signal being used by the compare and store circuit 51 in the manner fully described in the above-identified patent. However, if the division counter is in the Division 4 state, the output of an AND gate 202 goes true when the state flip-flop 59 is set, thereby setting a control flip-flop 350, and at the same time setting a counter 356 into an initial count condition of N=12.

With the control flip-flop 350 set, clock pulses from the master clock are gated by an AND gate 351 to the shift input of the A register 102, thus shifting the twelve bits stored in the A register serially to one input of an AND gate 358. The bits in the A register, each of which corresponds to a different one of the twelve notes in an octave, are shifted out starting with the highest note in the octave, e.g., the note C, to the lowest note, e.g. note B. The shift pulses from the AND gate 351 are applied to a second input of the AND gate 358. Whenever the monophonic note from Division 1 stored in the A register 102 is shifted out, the output of the AND gate 358 goes true, thereby resetting the flip-flop 350.

The clock pulses from the output of the AND gate 351 are also used to shift the B register 104. The B register 104 is shifted in an end-around mode, with the bits shifted out of the B register 104 being applied to one input of an AND gate 359. Clock pulses are provided to the second input of the AND gate 359 from one of two sources, namely, the shift pulses from the output of the AND gate 352 and clock pulses from the output of the AND gate 352'. The AND gates are controlled by a flip-flop 353 which is initially in the reset state but which is set at the same time the flip-flop 350 is reset. Thus it will be seen that the A register and B register are shifted simultaneously until the bit identifying the keyed note in the Division 1 keyboard is shifted out of the A register. At this point in time the shifting of the A register 102 is interrupted but the shifting of the B register 104 continues. At the same time the clock pulses from the AND gate 352 cause the counter 356 to begin counting down. As a result the AND gate 359 only goes true when a note lower in the octave then the note stored in the A register is shifted out of the B register 104.

The output of the AND gate 359 is applied as one input to an AND gate 360. The other input to the AND gate 360 is derived from a NOR gate 361. The output of the NOR gate goes true only if the counter 356 is not in state N=12, state N=11, or state N=1. These three states of the counter correspond to a note stored in the B register which is the same as the note stored in the A register or is a half tone either side of the note stored in the A register. Thus the NOR gate 361 acts to prevent generation of a harmonic note that is the same or at a dissonance with respect to the melody note.

Whenever a note is shifted out of the B register 104 which is not one of these three notes, the output of the AND gate 360 goes true, thereby resetting the flip-flop 353 and halting further shifting of the B register 104. At the same time the output of the AND gate 360 is applied through an OR circuit 203 to an AND gate 204 for providing the HALT INC signal to the store and compare circuit 51. The state of the counter 356 now indicates the number of half tones below the melody note of the highest accompaniment note of the Division 2 keyboard which is the smallest interval in terms of half tones below the melody note and is more than a half tone below the melody note.

The number stored in the counter 356 is applied through a data select circuit 357 to an automatic transposing circuit 300 which is of a type of circuit described in the above-identified copending application Ser. No. 951,168, filed Oct. 13, 1978, entitled "Intrakeyboard Coupling and Transposition Control for a Keyboard Musical Instrument", by the same inventor and owned by the same assignee as the present application, and hereby incorporated by reference. The automatic transposition circuit 300, as described in the noted copending application, produces a number of half tone shifts determined by a digitally coded value K below the note identified by the input lines from the OR circuit 28. Since the note identified on the lines from the OR circuit 28 is the melody note during the Division 4 state of the division counter 63, the output from the transposed circuit will be the desired harmony note.

In the event the counter 356 counts down to zero, indicating that either no key has been operated on the Division 2 keyboard, or the only key operated is within a half tone of the melody note, the data select 357 switches to a constant generator 362 which generates a coded signal having a digital value of K=9 or some other value at the input of the automatic transposition circuit 300. At the same time the zero count state of the counter 356 is applied to the OR circuit 203 to reset the flip-flop 353 and generate a HALT INC signal in the store and compare circuit 51.

What is claimed is:

1. Automatic harmony note generating means in a digital keyboard operated electronic instrument in which polyphonic tones are generated in response to musical pitch information stored in a tone generator assignment memory, comprising:

first means responsive to the depression of a selected key on the keyboard for generating electrically coded signals identifying the musical pitch of the melody note corresponding to the selected key, second means responsive to the depression of the same selected key for generating electrically coded signals identifying a harmony note that is a predetermined number of half tones in pitch from said melody note corresponding to the selected key, said second means including settable means for selectively generating a coded key signature signal identifying any selected key of the musical scale and means responsive to the key signature coded signal for adjusting said predetermined number of half tones difference between the musical pitch of said melody note and said harmony note, and means storing the coded signals from both said first and second means in the assignment memory.

2. Apparatus of claim 1 wherein said adjusting means adjusts the number of half tones by either a three or a four half tone difference from the harmony note depending on the half tone relationship between the key selected melody note and the selected signature key.

3. Apparatus of claim 2 wherein the number of half tones difference between the musical pitch of a melody note and the musical pitch of the harmony note is adjusted by said adjusting means by three half tones for any key selected melody note that is n half tones above the signature key where n is equal to 0, 1, 2, 5, 6, 7, 8, or 10 half tones, and is four half tones for any key selected melody note where n is equal to 3, 4, 9 or 11 half tones.

4. In a polyphonic tone synthesizer of a type having at least two keyboards having a key-operated switch for each key and means connecting the switches in groups, one group at a time, to a storage means for periodically storing the status of the keys in each group, and tone generator assignment memory means responsive to a change in status of any key when depressed on either keyboard for storing information identifying the note, octave, and keyboard of the depressed key, the tone synthesizer producing audible tones whose pitch and tone quality are determined by said stored note, octave, and keyboard information of each of the depressed keys, apparatus for automatically generating an additional note that is harmonically related in pitch to a melody note keyed on a first of said keyboards, comprising:

means responsive to operation of any key on the first keyboard for storing information identifying the melody note of the scale associated with the operated key, means responsive to operation of one or more keys on the second of said keyboards for storing information identifying the notes of the scale associated with the operated keys on the second keyboard, means comparing the key information stored for the respective keyboards for selecting a note in the musical scale played on the second keyboard, and means transferring the note information of the selected note on the second keyboard together with the octave information of the depressed key of the melody in the first keyboard to the tone generator assignment memory means.

5. The apparatus of claim 4 wherein said means comparing the key information stored for the respective keyboards for selecting the next lower note includes means excluding any identified note in the second keyboard that is not more than a half tone removed from the note of the depressed key on the first keyboard.

6. Apparatus of claim 4 further including means decrementing by one the octave information transferred to the tone generator assignment memory means when the note information identifies a harmony note on the second keyboard that is higher on the musical scale than the melody note.

7. The apparatus of claim 5 further including means signaling if no key is depressed on the second keyboard that is more than a half-tone removed from the note of the depressed key in the first keyboard, harmonic note generating means responsive to the signaling means for generating coded signals identifying a note that is a predetermined number of half tones lower than the note of the depressed key of the first keyboard, and means storing said coded signals in the tone generator assignment means.

8. The apparatus of claim 7 further including settable means for generating a key signature signal indicating the key signature in which the notes are being played on the keyboards, and means responsive to the key signature signal for controlling said number of half tones between the note of the depressed key of the first keyboard and the note identified by said coded signals from the harmonic note generating means.

* * * * *